US007327076B2

(12) United States Patent
Seon et al.

(10) Patent No.: US 7,327,076 B2
(45) Date of Patent: Feb. 5, 2008

(54) ELECTRON EMISSION DISPLAY HAVING A SPACER

(75) Inventors: Hyeong Rae Seon, Busan (KR); Jae Hoon Lee, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/286,315

(22) Filed: Nov. 22, 2005

(65) Prior Publication Data

US 2006/0138932 A1 Jun. 29, 2006

(30) Foreign Application Priority Data

Nov. 29, 2004 (KR) ..... 10-2004-0098750

(51) Int. Cl.
*H01J 1/88* (2006.01)
*H01J 19/42* (2006.01)
*H01K 1/18* (2006.01)

(52) U.S. Cl. ..... 313/292; 313/495; 313/496; 313/497

(58) Field of Classification Search ..... 313/292, 313/495–497; 174/138 R; 361/758, 804
See application file for complete search history.

(56) References Cited

U.S. PATENT DOCUMENTS 5,486,126 A * 1/1996 Cathey et al. ..... 445/25
5,562,517 A * 10/1996 Taylor et al. ..... 445/25
5,619,097 A * 4/1997 Jones ..... 313/495
5,726,529 A 3/1998 Dean et al.
5,789,857 A * 8/1998 Yamaura et al. ..... 313/495
5,811,926 A * 9/1998 Novich ..... 313/495
6,172,456 B1 * 1/2001 Cathey et al. ..... 313/495
6,259,198 B1 * 7/2001 Yanagisawa et al. ..... 313/495
6,353,280 B1 * 3/2002 Shibata et al. ..... 313/292
6,377,328 B1 * 4/2002 Morimoto et al. ..... 349/155
6,768,255 B1 * 7/2004 Na ..... 313/495
6,809,469 B1 * 10/2004 Ito et al. ..... 313/495

(Continued)

FOREIGN PATENT DOCUMENTS

EP 1 313 124 A2 5/2003

(Continued)

OTHER PUBLICATIONS

European Search Report dated Feb. 16, 2006, for corresponding EP 05 11 1346 publication.

(Continued)

*Primary Examiner*—Sikha Roy
*Assistant Examiner*—Brian T Schoolman
(74) *Attorney, Agent, or Firm*—Christie, Parker & Hale, LLP

(57) ABSTRACT

An electron emission display includes: an electron emission substrate having at least one electron emission device formed thereon, an image forming substrate, and at least two spacers for supporting the electron emission substrate and the image forming substrate to be spaced apart from each other. Areas of the spacers per unit area are increased in at least one direction from a central region to a periphery region. The areas can be increased by, for example, increasing a cross-sectional area of each spacer or increasing the number of spacers. In another embodiment, heights of the spacers are decreased in at least one direction from the center region to the periphery region.

19 Claims, 9 Drawing Sheets

U.S. PATENT DOCUMENTS

2001/0054866 A1 12/2001 Cathey et al.
2003/0071553 A1* 4/2003 Ryu et al. ..... 313/292
2004/0021819 A1* 2/2004 Kadotani ..... 349/155

FOREIGN PATENT DOCUMENTS

JP 09073093 A * 3/1997
JP 2001312971 A * 11/2001
KR 2003-0031355 4/2003

OTHER PUBLICATIONS

Korean Patent Abstracts for Publication No. 1020030031355; Date of publication of application Apr. 21, 2003, in the name of Eung Jun Ji et al.

* cited by examiner

ELECTRON EMISSION DISPLAY HAVING A SPACER

CROSS-REFERENCE TO RELATED APPLICATIONS

This application claims priority to and the benefit of Korean Patent Application No. 2004-98750, filed Nov. 29, 2004, the entire disclosure of which is hereby incorporated herein by reference.

BACKGROUND

1. Field of the Invention

The present invention relates to an electron emission display including a spacer and, more particularly, to an electron emission display that areas of spacers per unit areas in contact with a panel of the electron emission display are varied in at least one direction from a central region to a periphery region.

2. Discussion of Related Art

In general, an electron emission device uses a hot cathode or a cold cathode as an electron source. The electron emission device using the cold cathode may be of a field emitter array (FEA) type, a surface conduction emitter (SCE) type, a metal-insulator-metal (MIM) type, a metal-insulator-semiconductor (MIS) type, a ballistic electron surface emitting (BSE) type, and so on.

Using these electron emission devices, an electron emission display, various backlights, an electron beam apparatus for lithography, and so on can be implemented. An electron emission display includes a cathode substrate including an electron emission device to emit electrons, and an anode substrate for allowing the electrons to collide with a fluorescent layer to emit light. Generally, in an electron emission display, the cathode substrate is configured as a matrix, such that cathode electrodes and gate electrodes intersect each other, and includes a plurality of electron emission devices defined in the intersected regions, and the anode substrate includes fluorescent layers emitting light by the electrons emitted from the electron emission devices and anode electrodes connected to the fluorescent layers. The electron emission display is configured to drive the intersection regions in a matrix manner to selectively display the intersection regions. The cathode substrate and the anode substrate interpose a spacer therebetween in order to maintain a certain gap. The spacer functions to prevent the electron emission device and the anode substrate from being deformed and damaged due to a pressure difference between inner and outer parts when a space between the electron emission device and the anode substrate is vacuum-packaged, and to reduce non-uniformity of brightness based on emission positions by uniformly maintaining the gap between the two substrates.

An example of the electron emission display adapting the aforementioned spacer is disclosed in Korean Patent Laid-open Publication No. 2003-31355.

FIG. 1 is a cross-sectional view of an electron emission display including a conventional spacer. The electron emission display includes an electron emission device 10, an anode substrate 20, line-shaped cathode electrodes 12 provided at a surface of the electron emission device 10, line-shaped gate electrodes 16 perpendicularly intersecting the cathode electrodes 12 and interposing insulating layers 14 therebetween, a line-shaped anode electrode 22 provided at a surface of the anode substrate in the same direction as the cathode electrodes 12. A plurality of openings in the gate electrodes 16 and the insulating layers 14 are formed at pixel regions, at which the cathode electrodes 12 and the gate electrodes 16 intersect each other. Also included are electron emission parts 18 made of a carbon-based material such as carbon nanotube (CNT) and so on are provided at the cathode electrodes 12 in the respective openings. Fluorescent layers 24 emitting light when electrons emitted from the electron emission parts 18 collide therewith are provided at a surface of the anode electrode 22 at positions opposite to the electron emission parts 18. One end of the spacer 26 for supporting both vacuum-sealed substrates 10 and 20 is supported at the surface of the anode electrode 22 between the fluorescent layers 24, and the other end of the spacer 26 is supported at the gate electrode 16.

In the case of a display panel adapting the spacers, in general, spacers having the same shape are adapted under the condition that stress applied to the panel is uniform. However, since the stresses applied to the panel are different from each other based on its regions in spite of adaptation of the spacer, it is difficult to thoroughly suppress deformation of the substrate and to maintain uniformity of color reproduction due to brightness differences.

SUMMARY

Various embodiments of the present invention address one or more of the aforementioned problems associated with conventional displays by providing an electron emission display capable of uniformly distributing stress applied to a panel so that areas of spacers in contact with the panel are different from each other based on the region in which they are located.

In one embodiment of the present invention, an electron emission display includes: an electron emission substrate having at least one electron emission device formed thereon; an image forming substrate and at least two spacers for supporting the electron emission substrate and the image forming substrate to be spaced apart from each other. Areas of the spacers per unit area are increased in at least a first direction from a central region to a periphery region. The areas may be increased, for example, by increasing the cross-sectional area of the spacers or increasing the number of spacers.

In the electron emission display, the areas of the spacers per unit area may be increased in a radial direction from the central region to the periphery region. A ratio of the areas of the spacers per unit area of the periphery region to the central region may be in a range of about 1.05~1.35. In some embodiments, ratios of the area of the spacers per unit area of the periphery region to the central region are in a range of about 1.1~1.3. Heights of the spacers may be reduced in at least a second direction, which may be the same as the first direction, from the central region to the periphery region. Heights of the spacers may be reduced in a radial direction from the central region to the periphery region. A ratio of heights of the spacers in the central region to the periphery region may be in a range of about 1.002~1.018. A ratio of heights of the spacers of the central region to the periphery region may be in a range of about 1.005~1.015.

In another exemplary embodiment of the present invention, an electron emission display includes: an electron emission substrate having at least one electron emission device formed thereon; an image forming substrate; and at least two spacers for supporting the electron emission substrate and the image forming substrate to be spaced apart from each other. Cross-sectional areas of the spacers are increased in at least a first direction from a central region to a periphery region of the display.

In the electron emission display, a ratio of cross-sectional areas of the spacers in the periphery region to the central region may be in a range of about 1.05~1.35, or 1.1~1.3.

In yet another exemplary embodiment of the present invention, an electron emission display includes: an electron emission substrate having at least one electron emission device formed thereon; an image forming substrate; and at least two spacers for supporting the electron emission substrate and the image forming substrate to be spaced apart from each other. The number of the spacers is increased in at least a first direction from a central region to a periphery region.

In the electron emission display, a ratio of the number of the spacers in the periphery region to the number of spaces in the central region may be in a range of about 1.05~1.35 or 1.1~1.3.

In another embodiment of the invention, an electron emission display includes: an electron emission substrate having at least one electron emission device formed thereon; an image forming substrate; and at least two spacers for supporting the electron emission substrate and the image forming substrate to be spaced apart from each other. Heights of the spacers decrease from a central region to a periphery region of the display.

DETAILED DESCRIPTION

Figure 1:
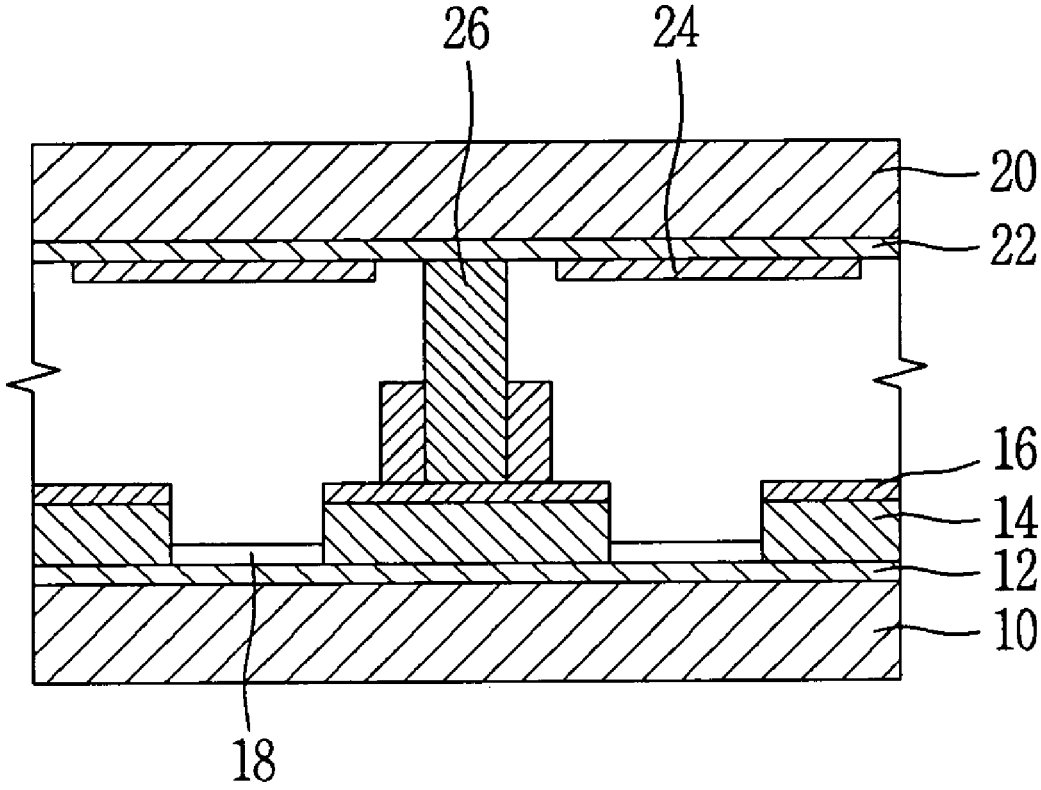
FIG. 1 (PRIOR ART)
FIG. 1 is a cross-sectional view of an electron emission display including a conventional spacer.
Figure 2:
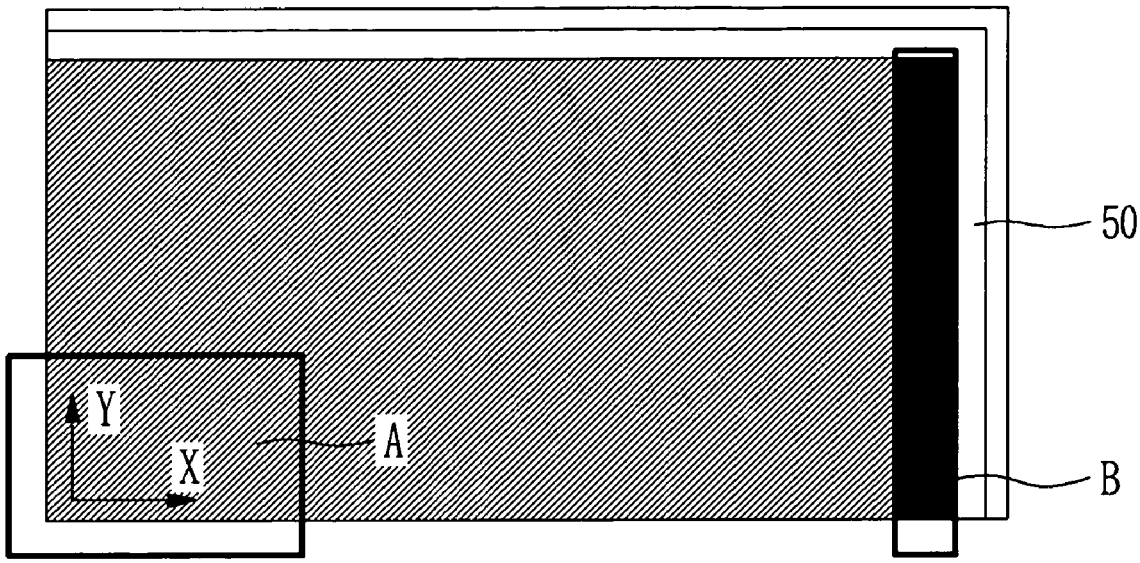
FIG. 2 is a distribution map illustrating displacement based on stress applied to a panel of an electron emission display.

FIG. 2 is a distribution map illustrating displacement based on stress applied to a panel of an electron emission display. Distribution of stress applied to a display panel 50 of an electron emission display is illustrated in grayscale coordinates, and it is appreciated that a central region A of the panel has a dark color in comparison with a periphery region B. That is, the stress from the exterior is larger in the periphery region B compared to the central region A of the panel. The reason for this is that a point of inflection of deformation of a top substrate (not shown) including glass is concentrated at the periphery region B, at which a support frame (not shown) is formed. When deformation of the top substrate is generated due to high stress of the periphery region B, a brightness difference between the central region A and the periphery region B is generated to reduce non-uniformity of color reproduction all over the panel.

Figure 3A:
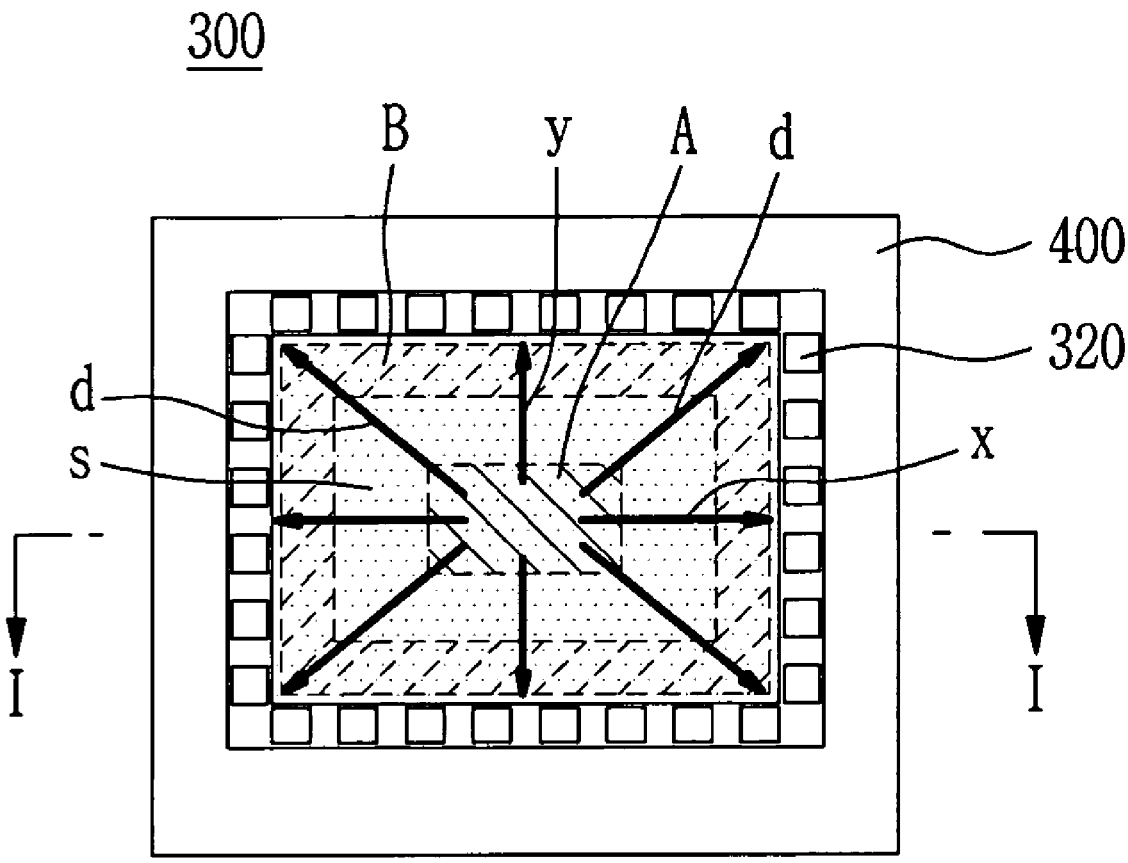
FIG. 3A is a schematic plan view of an electron emission display including a spacer according to an embodiment of the present invention.
Figure 3B:
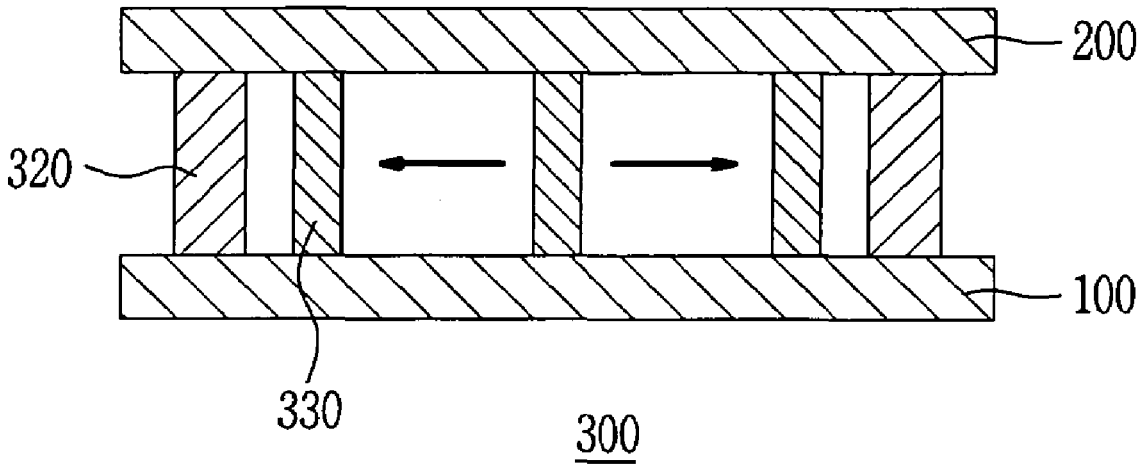
FIG. 3B is a cross-sectional view of the electron emission display taken along the line I-I in FIG. 3A.

FIG. 3A is a schematic plan view of an electron emission display including a spacer according to an embodiment of the present invention, and FIG. 3B is a cross-sectional view of the electron emission display taken along the line I-I in FIG. 3A.

The electron emission display 300 includes an electron emission substrate 100 having at least one electron emission device formed thereon, an image forming substrate 200 for forming an image based on collisions of electrons emitted from the electron emission device, and at least two spacers 330 for supporting the electron emission substrate 100 and the image forming substrate 200 to be spaced apart from each other. Areas of the spacers 330 per unit area in contact with the electron emission substrate 100 or the image forming substrate 200 are increased in at least one direction from a central region A to a periphery region B of the electron emission substrate 100 or the image forming substrate 200.

Support frames 320 for protecting the electron emission substrate 100 and the image forming substrate 200 are formed at the periphery of a display panel 400. In one embodiment, the support frames 320 are regular hexahedrons for the convenience of a sealing process, but the support frames are not limited to this shape. The support frames 320 can be made of materials such as sodalime, but the material is not limited thereto, and may be made of PD200, ceramic, and so on.

In one embodiment, the support frames 320 are made of materials having low thermal deformation characteristics equal to a thermal expansion coefficient of the electron emission substrate 100 and the image forming substrate 200. In one embodiment, the thermal deformation characteristic is not more than 20% of the thermal expansion coefficient of the substrates 100, 200. The thermal expansion coefficient means a ratio of variation in volume or length with respect to a variation of 1° C. in temperature.

In the region where the electron emission device is formed on the display panel 400, i.e., a spacer forming region s, the area of the spacer per unit area in contact with the electron emission substrate 100 and the image forming substrate 200 is increased in at least one direction x, y, or d from the central region A to the periphery region B of the panel. That is, the ratio of the area of the spacer 330 per unit area of the periphery region B to the central region A is determined to correspond to the stress distribution map shown in FIG. 2. In some embodiments, the ratio is in a range of 1.05~1.35 or in a range of 1.1~1.3.

In another embodiment, the direction of increase of the areas of the spacers 330 is distributed in an x direction, a y direction, a d direction (diagonal direction), or a radial direction from the central region A.

Therefore, excessive stress generated from the support frame 320 may be uniformly distributed all over the panel by increasing the area of the spacers in at least one direction from the central region A to the periphery region B. This allows greater uniformity of brightness.

A specific method of increasing the area of the spacers 330 per unit area from the central region A to the periphery region B is to increase the cross-sectional areas or "footprints" of the individual spacers 330 in at least one direction, and ratios of the cross-sectional areas of the individual spacers of the periphery region B to the central region A are preferably in a range of 1.1~1.3.

Another method is to increase the number of the spacers 330 in at least one direction, and ratios of the numbers of the spacers of the periphery region B to the central region A in one embodiment, is in a range of 1.1~1.3. Variations of the cross-sectional areas of the individual spacers has the same effect as variation of the number of the spacers.

In this process, the electron emission substrate 100 includes at least one electron emission device (not shown), and the electron emission device includes a first electrode (not shown), a second electrode (not shown) electrically insulated from and intersecting the first electrode, and an electron emission part (not shown) electrically connected to the first electrode, wherein electrons are emitted from the electron emission part by an electric field formed due to a voltage applied to the first and second electrodes. The image forming substrate 200 includes fluorescent layers (not shown) emitting light by the electrons emitted from the electron emission display, and an anode electrode (not shown) electrically connected to the fluorescent layers, wherein a voltage for accelerating the emitted electrons to the fluorescent layers is applied to the anode electrode to display a predetermined image.

Figure 4A:
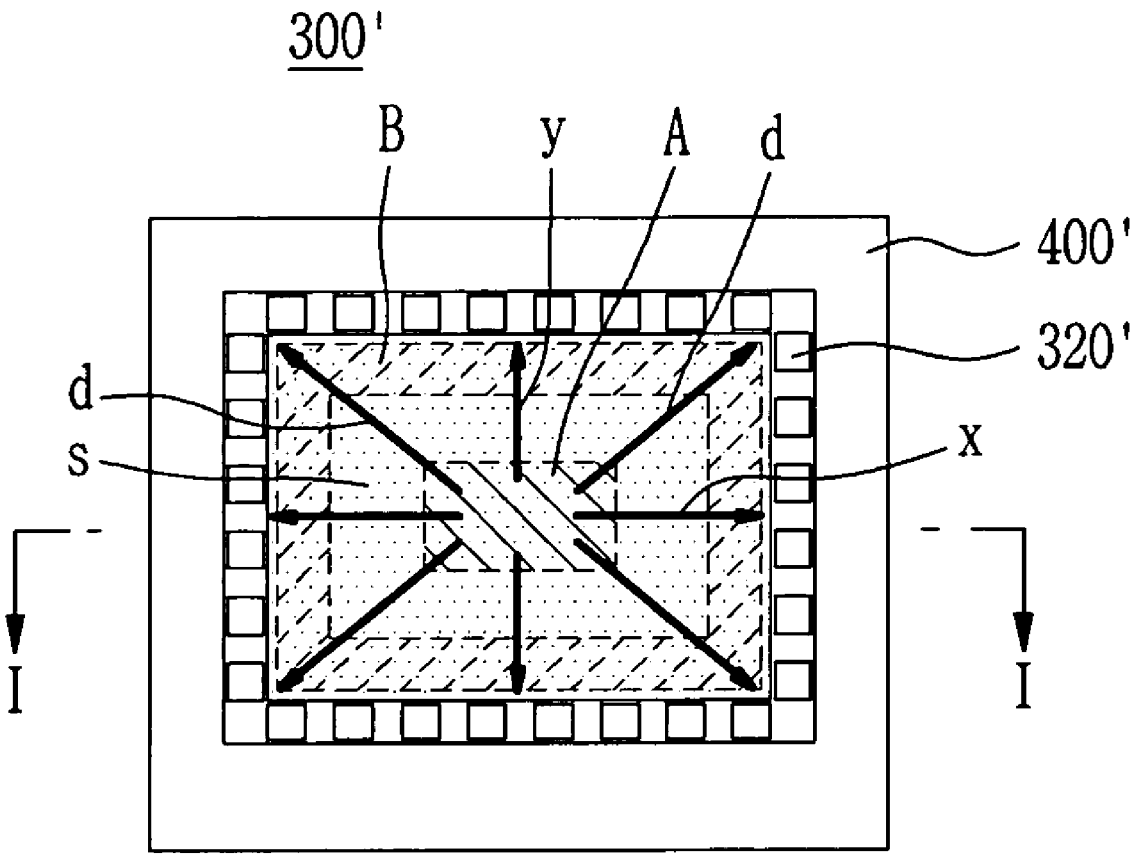
FIG. 4A is a schematic plan view of an electron emission display adapting a spacer according to another embodiment of the present invention.
Figure 4B:
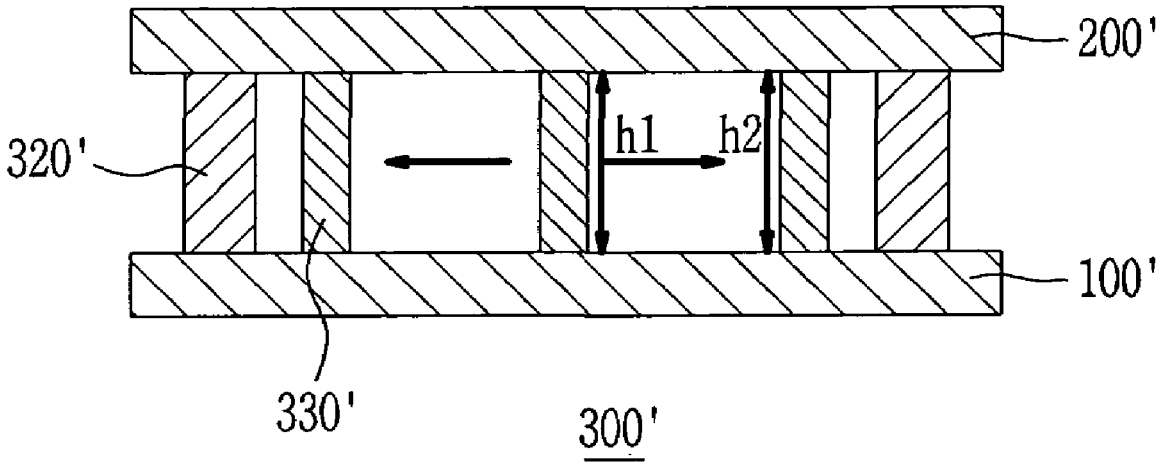
FIG. 4B is a cross-sectional view of the electron emission display taken along the line I-I in FIG. 4A.

FIG. 4A is a schematic plan view of an electron emission display adapting a spacer according to another embodiment of the present invention, and FIG. 4B is a cross-sectional view of the electron emission display taken along the line I-I in FIG. 4A.

Referring to FIGS. 4A and 4B, the electron emission display 300' includes an electron emission substrate 100' including at least one electron emission device formed thereon, an image forming substrate 200' for forming an image based on collisions of electrons emitted from the electron emission device, and at least two spacers 330' for supporting the electron emission substrate 100' and the image forming substrate 200' to be spaced apart from each other, wherein heights of the spacers 330' are decreased in at least one direction from a central region A to a periphery region B.

Support frames 320' for protecting the electron emission substrate 100' and the image forming substrate 200', spaced apart from each other, are formed at the periphery of a display panel 400'. In one embodiment, the support frames 320' are regular hexahedrons for the convenience of a sealing process, but the shape is not limited thereto. The support frames 320' are made of materials such as sodalime, but the materials are not limited thereto, and may be made of PD200, ceramic, and so on.

In addition, in one embodiment, the support frames 320' are made of materials having low thermal deformation characteristics equal to a thermal expansion coefficient of the electron emission substrate 100' and the image forming substrate 200', In one embodiment, the thermal deformation characteristic is not more than 20% of the thermal expansion coefficient of the substrates 100', 200'.

In one embodiment, in the region where the electron emission device is formed on the display panel 400', the heights of the spacers in contact with the electron emission substrate 100' and the image forming substrate 200' are decreased in at least one direction x, y or d from the central region A to the periphery region B of the panel. That is, the ratio h1/h2 of the height h1 of the spacer 330' formed at the central region A to the height h2 of the spacer formed at the periphery region B is determined depending on external pressure applied to the display panel 400'. In some embodiments, the ratio is in a range of 1.002~1.018, or 1.005~1.015. The ratio h1/h2 of the spacers 330' is determined by a deformation ratio of the central region A to the periphery region B by atmospheric pressure. The deformation ratio in some embodiments corresponds to the ratio of the heights of the spacers.

In some embodiments, the direction in which the heights of the spacers 330' are decreased is distributed in an x direction, a y direction, a d direction (diagonal direction), or a radial direction from the central region A.

Therefore, the stress by the external atmospheric pressure may be uniformly distributed all over the panel by decreasing the heights of the spacers in at least one direction from the central region A to the periphery region B. This uniformity in pressure helps provide uniformity of brightness.

The electron emission substrate 100' includes at least one electron emission device (not shown), and the electron emission device includes a first electrode (not shown), a second electrode (not shown) electrically insulated from and intersecting the first electrode, and an electron emission part (not shown) electrically connected to the first electrode, wherein electrons are emitted from the electron emission part by an electric field formed due to a voltage applied to the first and second electrodes. The image forming substrate 200' includes fluorescent layers (not shown) emitting light by the electrons emitted from the electron emission display, and an anode electrode (not shown) electrically connected to the fluorescent layers, wherein a high voltage for accelerating the emitted electrons to the fluorescent layers is applied to the anode electrode to display a predetermined image.

In this process, the x direction means a lateral direction of the display panel 400', and the y direction means a longitudinal direction of the display panel.

As described above, the heights of the spacers are varied based on the atmospheric pressure applied to the display panel to enable improvement of the brightness difference between right and left sides or upper and lower sides and therefore to maintain uniformity of color reproduction.

Figure 5A:
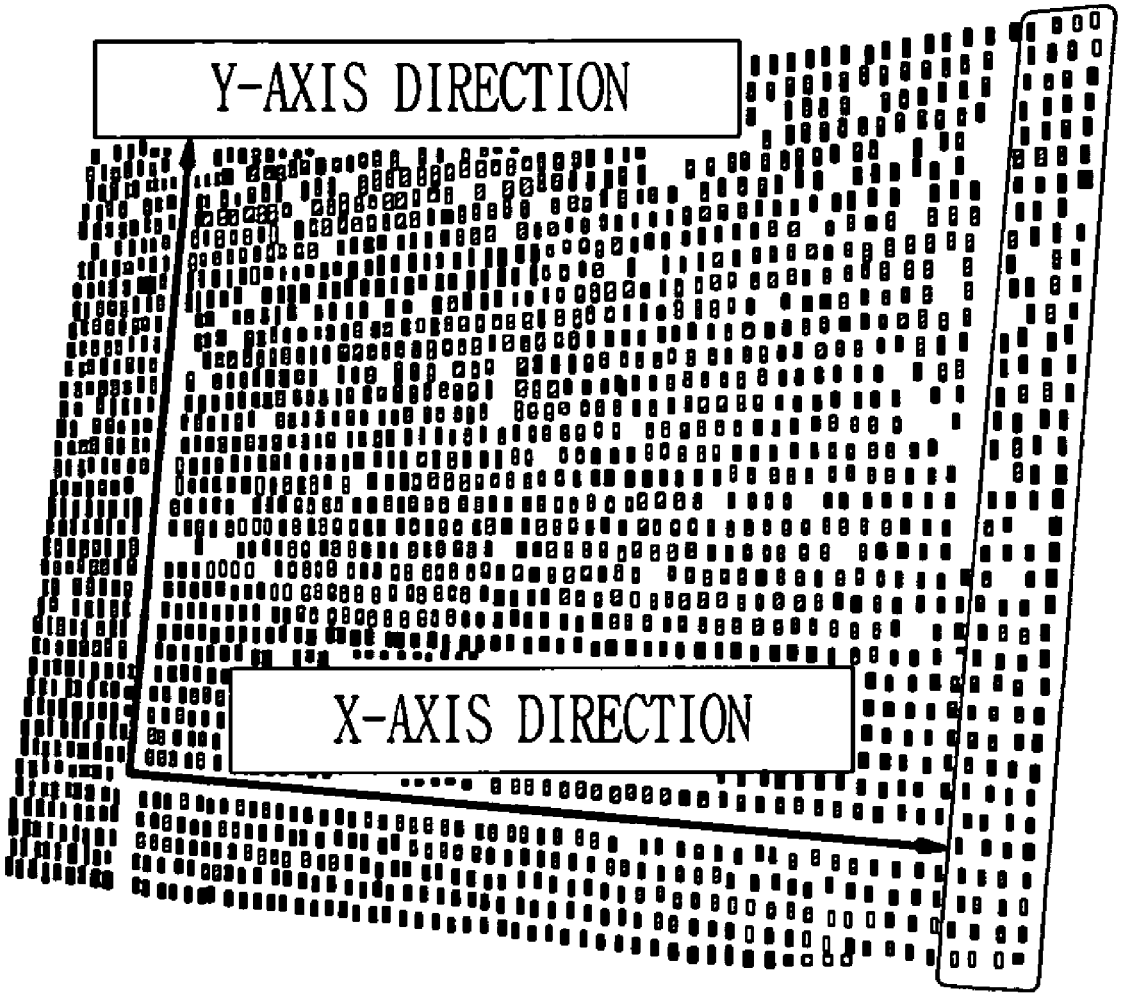
FIG. 5A is a distribution map illustrating stresses applied to a panel of an electron emission display adapting a spacer according to an embodiment of the present invention.
Figure 5B:
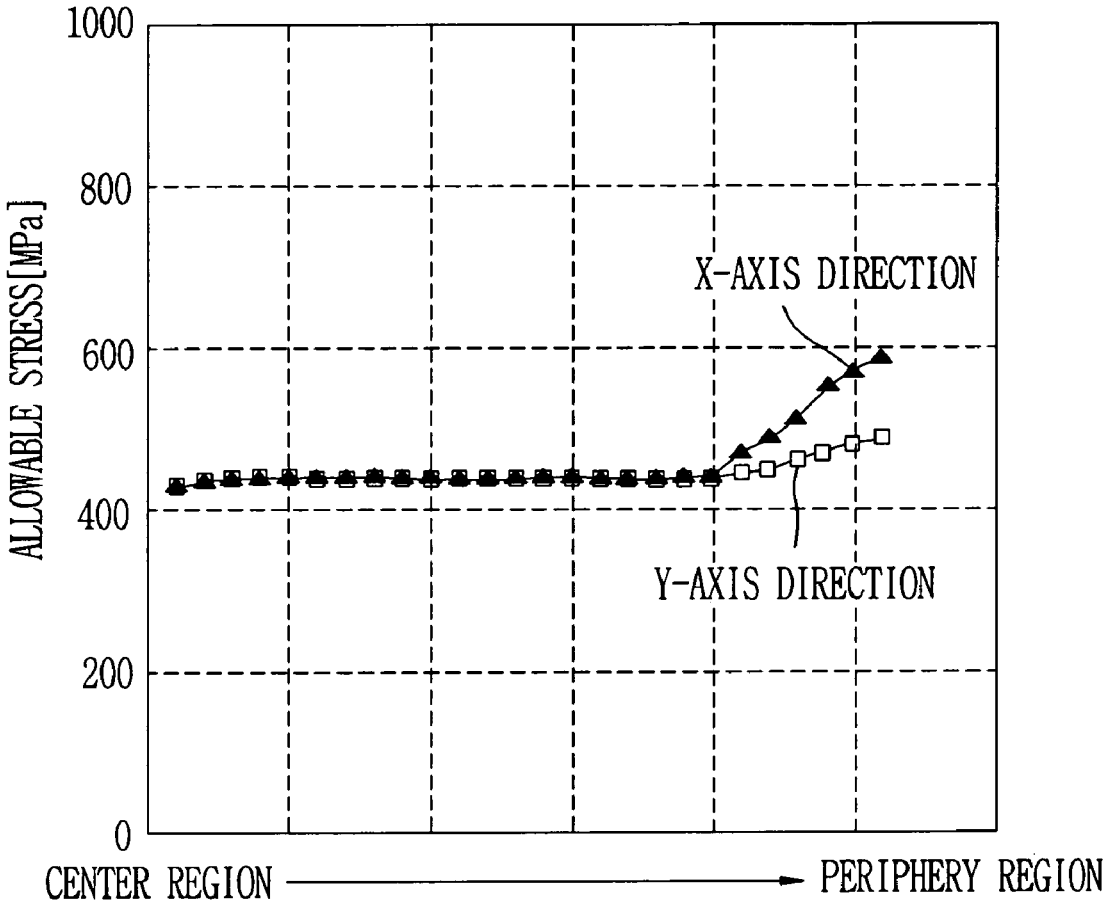
FIG. 5B is a graph illustrating the stress distribution map of FIG. 5A in two-dimensional coordinates.

FIG. 5A is a distribution map illustrating stresses applied to a panel of an electron emission display adapting a spacer according to an embodiment of the present invention, and FIG. 5B is a graph illustrating the stress distribution map of FIG. 5A in two-dimensional coordinates.

Referring to FIGS. 5A and 5B showing the stress applied to the spacers in grayscale levels along the x and y directions, it is appreciated that allowable stress is increased from the central region to the periphery region, and the reason for this is that the areas of the spacers per unit areas are increased from the central region to the periphery region and therefore the allowable stress is relatively increased corresponding thereto.

In the case of the allowable stress in the x direction, the allowable stress of the periphery region is higher than that of the central region by about 1.2 times, that is, the allowable stress of the central region is 420 Mpa, and the allowable stress of the periphery region is 590 Mpa.

In the case of the allowable stress in the y direction, the allowable stress of the periphery region is higher than that of the central region by about 1.1 times, that is, the allowable stress of the central region is 420 Mpa, and the allowable stress of the periphery region is 480 Mpa.

Figure 6:
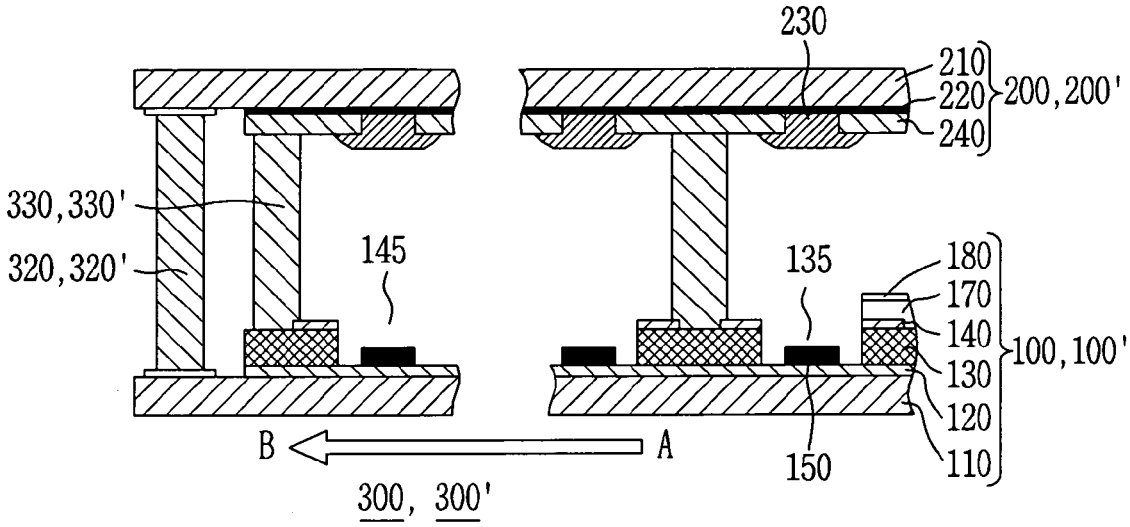
FIG. 6 is a cross-sectional view illustrating a configuration of the electron emission display of FIG. 3B or 4B.

In this process, the x direction means a lateral direction of the display panel 400', and the y direction means a longitudinal direction of the display panel. The reason that the allowable stress in the x direction is higher than that in the y direction is that the display panel has a length in the x direction larger than that in the y direction FIG. 6 is a cross-sectional view illustrating a configuration of the electron emission display of FIGS. 3B or 4B. Here, FIG. 6 illustrates a specific embodiment of the electron emission display adapting a spacer according to the present invention, but the configuration is not limited thereto.

The electron emission substrate 100 includes at least one electron emission device formed thereon, and emits electrons from an electron emission part 150 connected to a cathode electrode 120 by an electric field formed between the cathode electrode 120 and a gate electrode 140. While the electron emission device is illustrated to have a lower gate 140 and an upper gate 180 with layer 170 therebetween in the embodiment shown, various structures including having only a lower gate structure, can be adapted to the present invention.

At least one cathode electrode 120 is disposed on a bottom substrate 110 in a predetermined shape, for example, a stripe shape. The bottom substrate 110 is generally made of a glass or silicon substrate, such as a transparent substrate such as a glass substrate when it is formed through an exposure process from a rear surface using carbon nanotube (CNT) paste as an electron emission part 150.

The cathode electrodes 120 supply each of data signals or scan signals applied from a data driving part (not shown) or a scan driving part (not shown) to each electron emission device. In this process, the electron emission device includes the electron emission part 150 at a region, at which the cathode electrode 120 and the gate electrode 140 intersect each other. The cathode electrode 120 is made of indium tin oxide (ITO) due to the same reason as the substrate 110.

An insulating layer 130 is formed on the substrate 110 and the cathode electrode 120 to electrically insulate the cathode electrode 120 from the gate electrode 140. The insulating layer 130 includes at least one first hole 135 at an intersection region of the cathode electrode 120 and the gate electrode 140 to expose the cathode electrode 120.

The gate electrodes 140 are disposed on the insulating layer 130 in a predetermined shape, for example, stripe shape, in a direction intersecting the cathode electrode 120, and supply each of data signals or scan signals applied from the data driving part or the scan driving part to each of the electron emission devices. The gate electrode 140 includes at least one second hole 145 corresponding to the first hole 135 to expose the electron emission part 150.

The electron emission part 150 is located on the cathode electrode 120 exposed through the first hole 135 of the insulating layer 130 to be electrically connected to the cathode electrode 120, and preferably, is made of carbon nanotube, graphite, graphite nanofiber, diamond carbon, C60, silicon nanowire, and their composite materials.

The image forming substrate 200 includes a top substrate 210, an anode electrode 220 formed on the top substrate 210, fluorescent layers 230 formed on the anode electrode 220 to emit light by electrons emitted from the electron emission part 150, and light-shielding layers 240 formed between the fluorescent layers 230.

The fluorescent layers 230 emit light by the collision of the electrons emitted from the electron emission parts 150 and are disposed spaced apart from each other by an arbitrary interval on the top substrate 210. The fluorescent layers mean individual monochrome fluorescent layers. For example, the embodiment illustrates that the fluorescent layers individually express red (R), green (G) and blue (B) colors, but the flourescent layers are not limited thereto. The top substrate 210 may be made of a transparent material in order to allow the light emitted from the fluorescent layers 230 to be transmitted to the exterior.

The anode electrode 220 is formed on the top substrate 210 to more favorably collect the electrons emitted from the electron emission part 150. The anode electrode 220 is made of a transparent material. For example, the anode electrode 220 can be made of an indium tin oxide (ITO) electrode 220.

The light-shielding layers 240 spaced apart from each other by an arbitrary interval are disposed between the fluorescent layers 230 in order to absorb and block external light, prevent optical crosstalk, and improve contrast.

At least one spacer 330' is interposed between the electron emission substrate 100, 100' and the image forming substrate 200, 200' to maintain a certain gap and an inner vacuum space between the both substrates 100, 100' and 200, 200' against the atmospheric pressure applied from the exterior of the electron emission display 300, 300'. One end of the spacer 330, 330' contacts the light-shielding layer 240, and the other end of the spacer 330, 330' contacts the insulating layer 130. In this connection, areas of the spacers 330, 330' per unit areas are increased from a central region A to a periphery region B. Therefore, stress applied to the display panel is uniformly distributed to improve a brightness difference between the right and left sides or the upper and lower sides and to maintain uniformity of color reproduction.

The electron emission display 300, 300' as described above includes a support frame 320, 320' for supporting the electron emission substrate 100, 100' and the image forming substrate 200, 200' to seal the both substrates 100, 100' and 200, 200' and to maintain in a vacuum state. A positive voltage is applied to the cathode electrode 120, a negative voltage is applied to the gate electrode 140, and a positive voltage is applied to the light-shielding layer 240, from an external power source. As a result, an electric field is formed around the electron emission part 150 due to a voltage difference between the cathode electrode 120 and the gate electrode 140 to emit electrons, and the emitted electrons are induced by a high voltage applied to the anode electrode 220 to collide with fluorescent layers 230 of the corresponding pixel to emit light from the fluorescent layers 230, thereby forming a predetermined image.

As can be seen from the foregoing, electron emission displays according to various embodiments of the present invention are capable of preventing deformation and damage of the substrate generated around the display panel, and also uniformly maintaining color reproduction by compensating a brightness difference between right and left sides or upper and lower sides of the display panel.

Although the present invention has been described with reference to certain embodiments thereof, it will be understood by those skilled in the art that a variety of modifications and variations may be made to the present invention without departing from the spirit or scope of the present invention defined in the appended claims, and their equivalents.

What is claimed is:

1. An electron emission display having a display region and a non-display region outside of the display region, the electron emission display comprising:

an electron emission substrate having at least one electron emission device in the display region;

an image forming substrate; and spacers in the display region for separating the electron emission substrate from the image forming substrate, wherein areas of the spacers per unit area are increased in at least a first direction from a central region to a periphery region of the electron emission display.

2. The electron emission display according to claim 1, wherein the first direction is a radial direction from the central region to the periphery region.

3. The electron emission display according to claim 1, wherein a ratio of the areas of the spacers per unit area in the periphery region to the areas of the spacers per unit area in the central region is in a range of substantially 1.05~1.35.

4. The electron emission display according to claim 1, wherein a ratio of the areas of the spacers per unit area in the periphery region to the areas of the spacers per unit area in the central region is in a range of substantially 1.1~1.3.

5. The electron emission display according to claim 1, wherein heights of the spacers are reduced in at least a second direction from the central region to the periphery region.

6. The electron emission display according to claim 5, wherein the second direction is a radial direction from the central region to the periphery region.

7. The electron emission display according to claim 5, wherein the second direction is the same as the first direction.

8. The electron emission display according to claim 5, wherein a ratio of the heights of the spacers in the central region to the heights of the spacers in the periphery region is in a range of substantially 1.002~1.018.

9. The electron emission display according to claim 5, wherein a ratio of the heights of the spacers in the central region to the heights of the spacers in the periphery region is in a range of substantially 1.005~1.015.

10. The electron emission display of claim 1, wherein the areas of the spacers per unit area are increased by increasing the cross-sectional areas of each of the spacers.

11. The electron emission display of claim 1, wherein the areas of the spacers per unit area are increased by increasing the number of spacers.

12. An electron emission display having a display region and a non-display region outside of the display region, the electron emission display comprising:

an electron emission substrate having at least one electron emission device in the display region;

an image forming substrate for forming an image based on collisions of electrons emitted from the electron emission device; and spacers in the display region for separating the electron emission substrate from the image forming substrate, wherein cross-sectional areas of the spacers are increased in at least a first direction from a central region to a periphery region.

13. The electron emission display according to claim 12, wherein a ratio of the cross-sectional areas of the spacers in the periphery region to the cross-sectional areas of the spacers in the central region is in a range of substantially 1.1~1.3.

14. The electron emission display according to claim 12, wherein the first direction is a radial direction.

15. The electron emission display according to claim 12, wherein heights of the spacers are reduced in at least a second direction from the central region to the periphery region.

16. The electron emission display according to claim 15, wherein the second direction is the same as the first direction.

17. An electron emission display having a display region and a non-display region outside of the display region, the electron emission display comprising:

an electron emission substrate having at least one electron emission device in the display region;

an image forming substrate for forming an image based on collisions of electrons emitted from the electron emission device; and spacers in the display region for separating the electron emission substrate from the image forming substrate, wherein the number of the spacers is increased in at least one direction from a central region to a periphery region.

18. The electron emission display according to claim 11, wherein ratios of the numbers of the spacers per unit areas of the periphery region to the central region are in a range of 1.1~1.3.

19. An electron emission display having a display region and a non-display region outside of the display region, the electron emission display comprising:

an electron emission substrate having at least one electron emission device in the display region;

and image forming substrate; and spacers in the display region for separating the electron emission substrate from the image forming substrate, wherein heights of the spacers are reduced in at least a first direction from a central region to a periphery region of the electron emission display.

* * * * *